US007666056B2

(12) United States Patent
Munoz et al.

(10) Patent No.: US 7,666,056 B2
(45) Date of Patent: Feb. 23, 2010

(54) STREAMER LAUNCHING SYSTEM

(75) Inventors: Raul Vicente Munoz, New Orleans, LA (US); James O. Watkins, Potomac, MD (US); Shirley Watkins, legal representative, Potomac, MD (US)

(73) Assignee: Parti-Line International, Inc., New Orleans, LA (US)

( * ) Notice: Subject to any disclaimer, the term of this patent is extended or adjusted under 35 U.S.C. 154(b) by 847 days.

(21) Appl. No.: 10/797,230

(22) Filed: Mar. 10, 2004

(65) Prior Publication Data

US 2005/0202753 A1 Sep. 15, 2005

(51) Int. Cl.
*A63H 37/00* (2006.01)
*A63H 33/30* (2006.01)

(52) U.S. Cl. ..... 446/475; 446/486; 446/487; 472/52

(58) Field of Classification Search ..... 446/475, 446/486, 487, 488, 308–311; 472/52, 54; 116/173

See application file for complete search history.

(56) References Cited

U.S. PATENT DOCUMENTS

| | | | | | |
|---|---|---|---|---|---|
| 503,387 | A * | 8/1893 | Schofield | 473/576 |
| 1,090,778 | A * | 3/1914 | Clark | 446/475 |
| 2,869,507 | A * | 1/1959 | Boyer | 116/173 |
| 3,560,313 | A * | 2/1971 | Herkimer | 428/4 |
| 4,571,921 | A * | 2/1986 | Wolfson | 53/374.8 |
| 5,010,667 | A * | 4/1991 | Hassinger | 40/309 |
| 5,354,227 | A * | 10/1994 | Watkins | 446/475 |
| 5,472,003 | A * | 12/1995 | Frame et al. | 132/275 |
| 5,542,870 | A * | 8/1996 | Westersund | 446/75 |
| 5,678,730 | A * | 10/1997 | Fabek et al. | 222/78 |
| 5,807,159 | A * | 9/1998 | Watkins | 446/475 |
| 6,748,896 | B2 * | 6/2004 | Hunsley | 116/173 |

* cited by examiner

*Primary Examiner*—Kien T Nguyen
(74) *Attorney, Agent, or Firm*—Gerow D. Brill; Ronald B. Sherer

(57) ABSTRACT

An apparatus for launching streamers is disclosed in which the streamers remain connected to the user's hand during and after launch.

17 Claims, 3 Drawing Sheets

STREAMER LAUNCHING SYSTEM

FIELD

The present invention relates to entertainment streamers which are launched into the air to form colorful displays at parties, sporting events and festive occasions.

BACKGROUND

It has long been known to launch streamers into the air to simulate colorful comets flying through the air. However, previous streamers have presented a difficult cleaning problem, and most sporting events prohibit streamers from landing on the playing field or even on the sidelines.

SUMMARY

The present invention solves these problems with a system which secures the loose end of the streamer to the user's hand thereby preventing the streamer from flying in an uncontrolled manner and thus provides easy and rapid clean-up.

DETAILED DESCRIPTION

Figure 1:
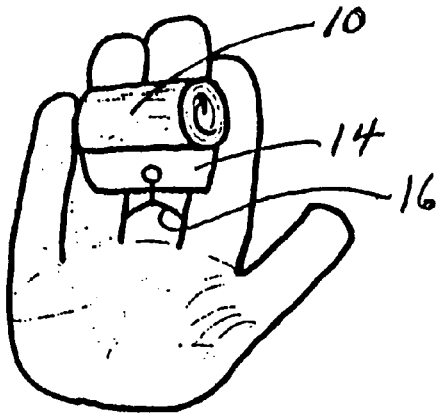
FIG. 1 is a perspective view of a streamer attached to a user's hand.
Figure 2:
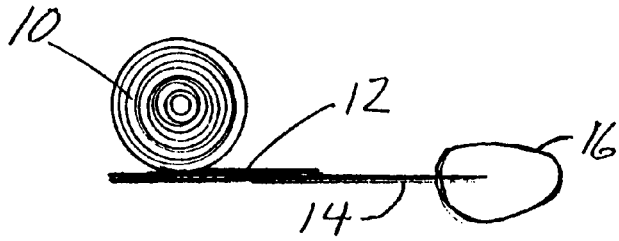
FIG. 2 is a side cross-sectional view of the streamer attached to a launch strip.

Referring first to FIGS. 1 and 2, the loose end 12 of a rolled streamer 10 is shown connected to a launch strip 14. The loose end 12 is preferably connected to the launch strip by an adhesive or adhesive tape, although other conventional means are possible. As shown in FIG. 2, the right hand end of the launch strip 14 is secured to a ring or flexible band 16 which is of a size such as to receive a finger of the user. Preferably, the launch strip includes a reinforcing element 14' such as for example a grommet or reinforcing tape. The launch strip may be composed of various flexible materials such as paper, tissue paper or plastic film. The paper or tissue paper may be provided in multiple layers to provide the necessary strength, or a single layer of plastic film such as Mylar may be used.

Figure 3:
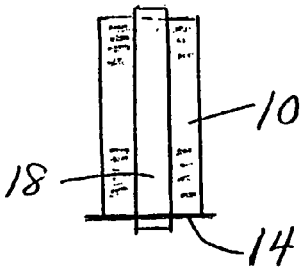
FIG. 3 is a top plan view of the streamer and launch strip secured together by a rubber band.

It will be understood that FIG. 2 illustrates streamer 10 as separated from ring 16 for purposes of clarity of the individual components, whereas FIG. 1 illustrates the streamer and the launch strip rolled together as they are when held in the hand of a user. While a number of means are possible to keep the streamer and launch strip rolled together prior to use, the preferred means is a small rubber band 18 as shown most clearly in FIG. 3 which surrounds the streamer and the launch strip.

Figure 4:
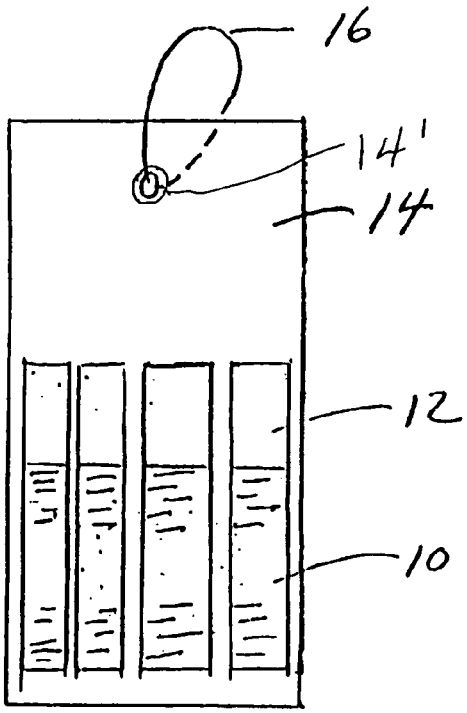
FIG. 4 is a top plan view showing multiple streamers attached to one launch strip.
Figure 5:
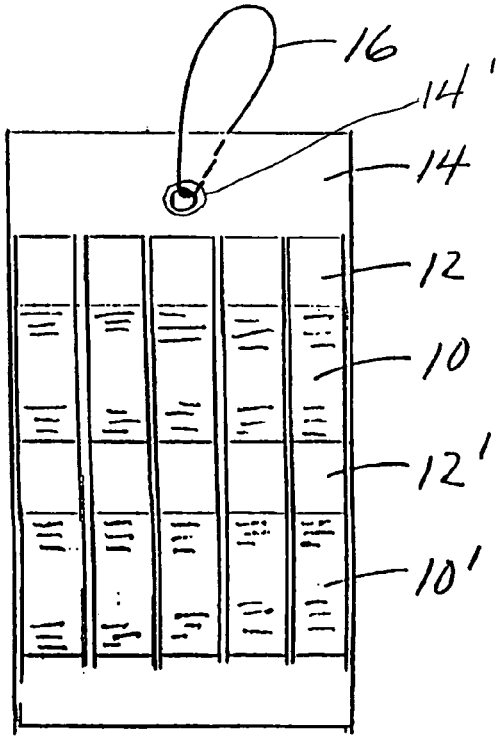
FIG. 5 is a top plan view showing multiple rows of streamers with multiple streamers in each row.

In use, the user inserts one finger through ring 16 and then removes rubber band 18. In this manner, the end of the launch strip is secured to the user's hand and the streamer is secured only by the user's hand enclosing it. The user then waves his arm and hand in a backhand or under-hand throwing motion and the streamer flies out of the user's hand. The streamer unrolls in the air and presents a colorful image flying through the air like a comet. With the streamer still connected to the user's hand, it is very easy to pull the streamer back to the user in order to remove it and clean the area. In addition, more than one streamer may be connected to launch strip 14 as shown in FIG. 4 where the loose ends 12 of four streamers are shown connected to the launch strip 14. It has been found that for creating the visual display of multiple comets flying in the air the preferred number of streamers is in the order of 4 to 12.

It will be understood that the multiple layers of the wound streamer may be slippery, and particularly when they are composed of metallized plastic film. As a result, it has been discovered that there may be a tendency for the inner layers of the streamer to fall out of the rolled streamer when the rubber band 18 is removed, or later then the streamer is about to be launched.

Figure 6:
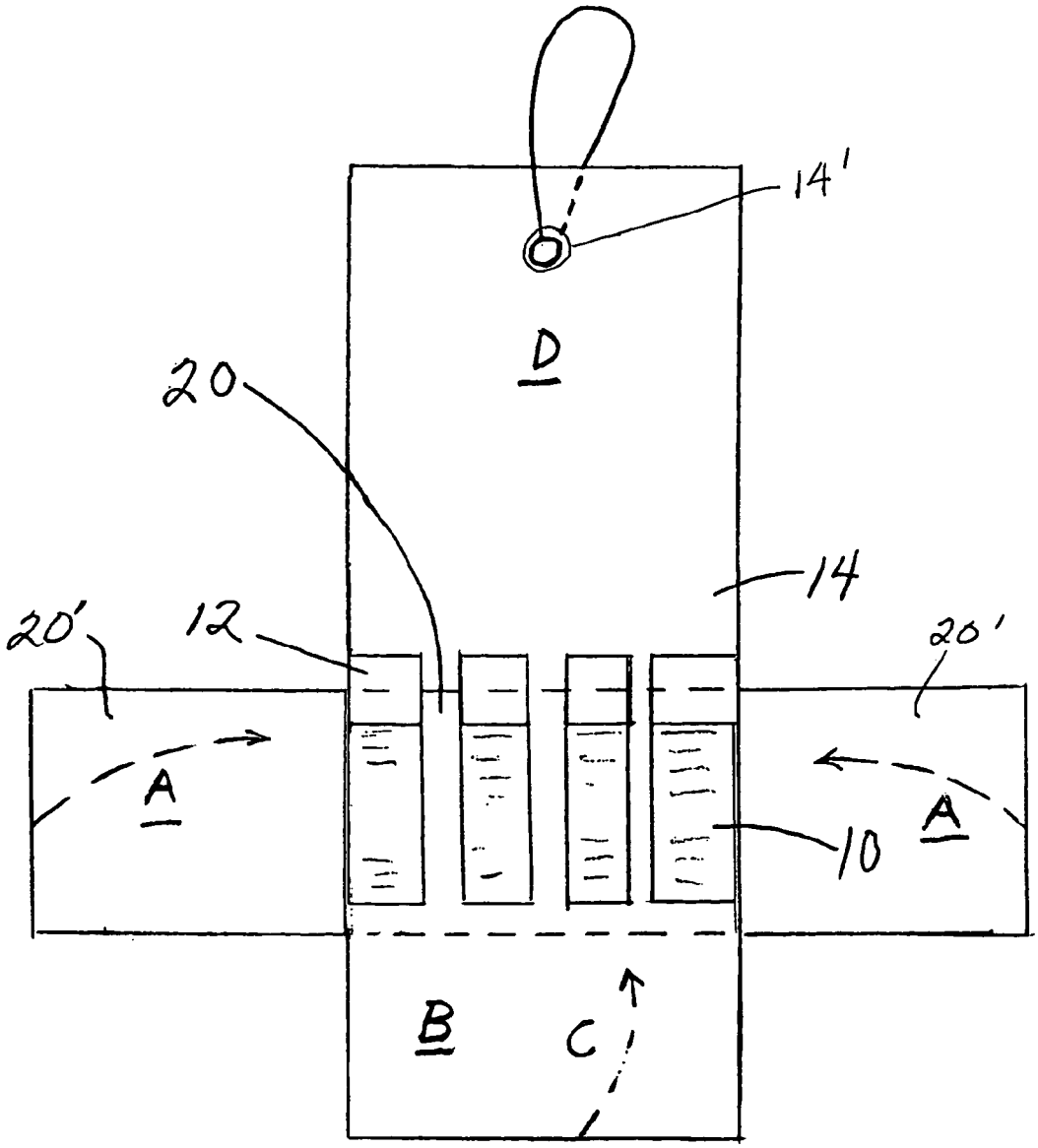
FIG. 6 is a top plan view of an alternative embodiment of the launch strip.

This problem has been solved by providing a side wrapper 20 as illustrated in FIG. 6. Wrapper 20 is preferably secured to the underneath side of launch strip 14 by an adhesive and the ends of the wrapper form tabs or wings 20'. Alternatively, the launch strip may be cutout with similar wings as to be an integral, one-piece construction. In either case, wrapper 20 may be composed of paper, tissue paper or plastic film.

In assembly, wrapper 20 is secured to the launch strip and the loose ends of the streamers are secured to the launch strip as previously described. Wings 20' are then folded upwardly and over the streamers as shown by arrow A. The size of the wrapper is preferably such as to overlap when folded inwardly over the streamers. The bottom portion B of the launch strip is then folded upwardly and over the wings as shown by arrow C. This forms a secure wrapping around the streamers forming a bundle. Then portion D of the launch strip is wrapped around the wrapped bundle. In use, it will be understood that wings 20' and portion D of the launch strip burst open by virtue of the mass of the streamers and the centrifugal generated by the arm of the user such that the streamers are released to fly upwardly in the air.

In the foregoing description it has been assumed that the streamers are of substantial length, such as in the order of 3 to 15 feet for example, and that the desired visual effect is that of several colorful comets streaking through the air. In addition, however, the present invention may be used as a pom-pom.

As shown in FIG. 4, launch strip 14 may have a plurality of rows of streamers 10 connected to it. These may be long for creating the comet effect, or for use as a pom-pom, the length of the streamers should be shorter, such as in the order of 6 inches to 3 feet, and preferably in the order of ½ to 2 feet, and most preferably 8 to 16 inches. Therefore, in addition to creating the effect of a comet, the present invention may, alternatively, create the effect of a pom-pom as the hand is waved back and forth, or waved in circles, etc. as the multiple streamers dance and wave in the air like a pom-pom.

From the foregoing description it will be noted that the hand of the user attached to the launch strip is entirely free to clap or perform any other motion with that hand, unlike prior pom-poms which required the hand to grasp the handle.

With respect to preferred sizes and dimensions, the width of launch strip 14 is preferably in the order of 1-5 inches, and for most hands it is preferred to be in the order of 1-3 inches. The preferred width of the streamers is in the order of ¼ to ⅓ inches, and most preferably in the order of ⅜ to ¾ inches. With respect to the preferred number of streamers per row for launching streamers as comets, the preferred number is 2-6, and with preferably 2 to 3 rows.

From the foregoing description of several preferred embodiments it will be apparent that the present invention provides a streamer launching system which prevents an area from being cluttered, and which provides easy clean up while still providing the colorful visual effect of comet-like streamers in the air or dancing pom-poms.

From the foregoing description it will also be apparent that many modifications and variations of the invention will become apparent to those skilled in the art. Accordingly, it is to be understood that the foregoing description of one preferred embodiment is intended to be illustrative rather than exhaustive of the principles of the invention, and that the scope of the invention is not intended to be limited other than as set forth in the following claims interpreted under the doctrine of equivalents.

What is claimed is:

1. An apparatus for launching streamers comprising:

at least one rolled streamer;

a loose end of each rolled streamer coupled to a first end of a launch strip;

a second end of said launch strip coupled to a ring or flexible band;

means for keeping said apparatus rolled prior to use, and a side wrapper secured to an underneath side of said launch strip wherein the ends of said wrapper forms tabs or wings.

2. The apparatus of claim 1 wherein said wrapper is composed of various flexible materials selected from the group consisting of paper, tissue paper or plastic film.

3. The apparatus of claim 1 further comprising:

a reinforcing element for said launch strip.

4. The apparatus of claim 3 wherein said reinforcing element is a grommet or reinforcing tape.

5. The apparatus of claim 1 wherein said launch strip is composed of various flexible materials is selected from the group consisting of paper, tissue paper or plastic film.

6. The apparatus of claim 5 wherein said paper or tissue paper may be provided in multiple layers.

7. The apparatus of claim 5 wherein said plastic film may be provided in a single layer of Mylar.

8. The apparatus of claim 1 wherein said means for keeping said apparatus rolled comprises a rubber hand.

9. The apparatus of claim 1 wherein the number of streamers rolled within said apparatus is between 4 and 12 streamers.

10. The apparatus of claim 1 wherein each said rolled streamer is coupled to said launch strip with an adhesive or adhesive tape.

11. The apparatus of claim 1 wherein said streamers are 3 to 15 feet in length.

12. The apparatus of claim 1 wherein said launch strip has a width of 1 to 5 inches.

13. The apparatus of claim 1 wherein said launch strip has a width of 1 to 3 inches.

14. The apparatus of claim 1 wherein a width of said streamers is ¼ to 1¼ inches.

15. The apparatus of claim 1 wherein a width of said streamers is ⅜ to ¾ inches.

16. The apparatus of claim 1 further comprising 2 to 3 rows of said streamers.

17. The apparatus of claim 16 further comprising 2 to 6 said streamers per row.

* * * * *